United States Patent [19]

Linton et al.

[11] 4,079,525

[45] Mar. 21, 1978

[54] WEAPON RECOIL SIMULATOR

[75] Inventors: John D. Linton, Lake-In-The-Hills; Samuel P. Willits; William L. Mohan, both of Barrington, all of Ill.

[73] Assignee: Spartanics, Ltd., Rolling Meadows, Ill.

[21] Appl. No.: 695,069

[22] Filed: Jun. 11, 1976

[51] Int. Cl.[2] ..... F41F 27/00; G09B 9/00

[52] U.S. Cl. ..... 35/25; 273/101.2

[58] Field of Search ..... 35/25; 42/1 R; 273/101, 273/101.1, 101.2

[56] References Cited

U.S. PATENT DOCUMENTS

| | | | |
|---|---|---|---|
| 2,023,497 | 12/1935 | Trammell | 35/25 |
| 2,398,813 | 4/1946 | Swisher | 35/25 X |
| 2,486,008 | 10/1949 | Cutler | 35/25 |
| 2,520,281 | 8/1950 | Heide | 35/25 |
| 2,708,319 | 5/1955 | Trajsch | 35/25 |
| 3,535,809 | 10/1970 | Hoffmann | 42/1 R |
| 3,704,530 | 12/1972 | Arenson | 35/25 |

*Primary Examiner*—William H. Grieb
*Attorney, Agent, or Firm*—Jacque L. Meister

[57] ABSTRACT

An apparatus for simulating the recoil force of a weapon A recoil force generator is coupled through a linkage to the weapon in such a manner that the recoil force is substantially coaxial with the axis of the weapon over wide variations in weapon aiming positions. The simulated recoil force is also used to provide simulation of weapon recocking, round counting and empty weapon simulation.

26 Claims, 7 Drawing Figures

WEAPON RECOIL SIMULATOR

BACKGROUND OF THE INVENTION

This invention relates to a weapon training simulator and more particularly to means in such apparatus for imparting a recoil simulation.

In weapon training simulators, for hand-held weapons of the type that use no live ammunition, to provide realism in hands on training, it is desirable that the simulation include as much of the "feel" of actual weapon usage as possible. To the extent that such "feel" and function are simulated, there is a high statistical correlation between trainee performance on the simulator and with the actual weapon. The two principal components of "feel" other than the feel of the weapon itself, are the shot sound and the recoil of the weapon being simulated. Three important functions it is desirable to simulate are weapon recocking, round counting and empty weapon. Various shot sound synthesizers have been proposed in the prior art and one such synthesizer that has proven particularly desirable for its realism is described in the co-pending application of Linton, et al, Ser. No. 615,414. While various sound synthesizers are available all of which provide reasonably good sound simulation, recoil simulation in a realistic fashion without otherwise handicapping the feel of the weapon during use has proven more difficult and none of such recoil simulators are free of one or more serious drawbacks.

The recoil simulator described by Arenson in U.S. Pat. No. 3,704,530 imparts an electrical shock to the trainee; Hoffman in U.S. Pat. No. 3,535,809, described a plurality of firework containing cannisters mounted about a gun barrel with the fireworks being electrically detonated. Tratsch in U.S. Pat. No.2,708,319, describes an air actuated cylinder-spring combination which requires an air line connection and Swisher in U.S. Pat. No. 2,398,813 uses an electro-magnet powered hammer to move the hand-grips of an automatic weapon simulator.

Why recoil simulation is necessary or desirable becomes apparent when a consideration is given to the sources of weapon aiming errors. One of the largest sources of aiming error is a behavior syndrome commonly termed flinching and is an anticipatory reflex to the noise and recoil shocks incident to weapon firing. The behavioral manifestations of flinching are pushing or clutching of the weapon which causes weapon displacement at the time of actual firing to further disturb aim. Detection and correction of flinching is difficult since it is at least partially masked by actual response to recoil and sound.

Overcoming the flinching syndrome requires periodic training since even experienced shooters will flinch if a high powered weapon is fired after a prolonged period without shooting or, under stress of the type encountered in combat. To provide this periodic training for an experienced shooter or to train a novice, it has been found that firing with either none or low recoil and sound in the beginning and working gradually up to full sound and recoil provides one of the most effective training situations.

SUMMARY OF THE INVENTION

A Principal object of the invention is to provide a new and improved recoil simulation device.

Another object of the invention is to provide a new and improved recoil simulation device which overcomes the defects and objections of the prior art devices and provides a more realistic simulation than heretofore possible.

Still another object of the invention is to provide a new and improved recoil simulation device capable of providing an infinite progression of recoil forces from very low to a maximum.

Yet another object of the invention is to provide a new and improved recoil simulation device which can be used to effect recocking of a standard trigger mechanism.

Another object of the invention is to provide a new and improved recoil simulation device which incorporates the facility to enable round counting and to simulate depletion of rounds.

A further object of the invention is to provide a new and improved recoil simulation device capable of simulating the recoil of a weapon such as a rifle firing a single shot, a burst of several shots or a weapon firing in full automatic mode, such as a machine gun.

The foregoing and other objects of the invention are achieved by a particularly arranged low friction, low inertia mechanical coupling through the weapon muzzle incorporating a variable force and displacement generator which acts on the mechanical coupling in such a manner that the resultant force applied through the weapon muzzle is applied substantially along the weapon barrel axis with only negligible off-axis components. The nature of the invention and its several features and objects will more readily be apparent from the following description of certain preferred embodiments thereof taken in conjunction with the accompanying drawings.

DESCRIPTION OF THE PREFERRED EMBODIMENTS

Figure 1:
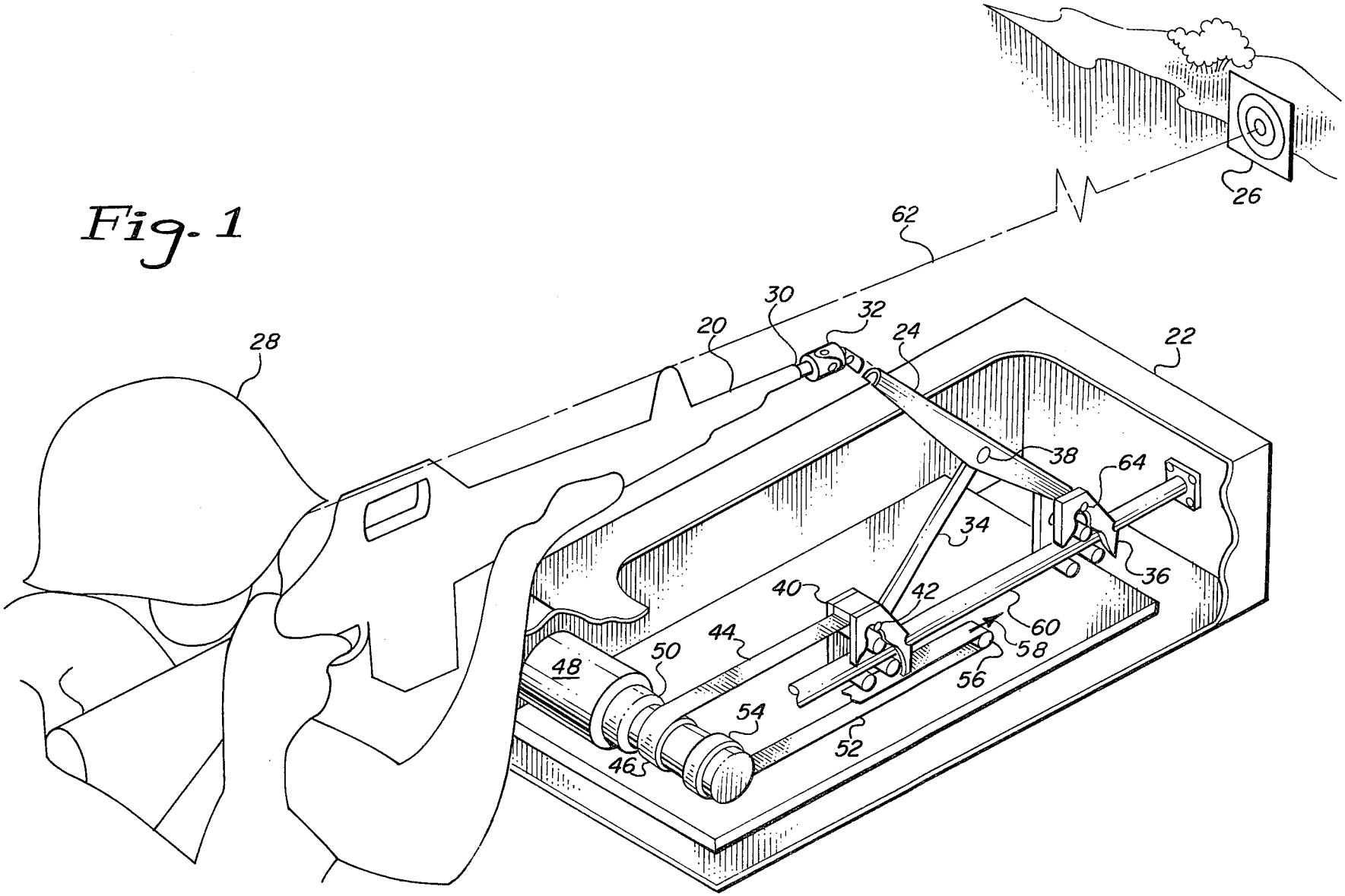
FIG. 1 is a perspective view of a weapon firing simulator incorporating the recoil simulation device of the invention.

FIG. 1 illustrates in perspecive form a weapon training simulator embodying the recoil simulator of the invention. As shown, the weapon simulator is principally comprised of a weapon 20 secured to a base support structure 22 through an arm 24 and a target 26 set in front of a real or simulated natural environment. As further described, base support structure 22 and arm 24 are so constructed that the weapon 20 can be held in a variety of comfortable aiming positions by the trainee 28 such as are incident to various trainees and target positions.

Recoil arm 24 applies force to the muzzle 30 of weapon 20 through a universal joint 32. Force is applied to recoil arm 24 through pull rod 34 and arm carriage 36. Pull rod 34 is connected to arm 24 by pivot 38 and arm carriage 36 is connected to arm 24 by pivot 64. Force is applied to pull rod 34 through rod carriage 40 at pivot 42. Force is applied to rod carriage 40 through tension tape 44 which is connected to and winds up on recoil tape drum 46. Drum 46 is, in turn, driven by drive motor 48 through recoil clutch 50.

Any tendency towards slack in tension tape 44 is eliminated by the action of slack tape 52 which unwinds from slack drum 54 as tension tape 44 winds up on recoil tape drum 46, and vice versa. Carriage bar 60 constrains rod carriage 40 and arm carriage 36 to linear motion along the axis of the bar and rotational movement around that axis. With the inventive arrangement and proportions of these components of the recoil simulator, the recoil motion is transferred to the weapon 20 in such a fashion that it accurately duplicates the feel of the recoil of a live weapon being fired. Of course cables or wires can be substituted for tension tape 44 and slack tape 52. Also, a rack and pinion arrangement can be substituted for the drum and tape arrangement. Furthermore, a linear clutch and driven rod 60 can be substituted to couple the recoil force generator to the recoil mechanism. As can also be seen, a pivot arm could readily be substituted for carriage rod 60 and carriage 36 as well as many other devices to achieve the application of recoil force to the weapon in accord with the inventive principles.

When a small arms weapon such as a rifle is aimed at a distant target, the direction of aim or sight line 62 changes very little if the weapon is moved up or down or sideways a foot or two. For example, with a 50 meter target, a motion of one foot changes the angle approximately one-third of a degree. This is desirable for a recoil simulator since ideally the motion of the weapon due to recoil is parallel and concentric with the weapon barrel. Since weapon angle, with respect to the target, changes very little with weapon position, it is possible to closely simulate a recoil force to be parallel with the weapon barrel with a device that applies recoil forces parallel to a nominal line of sight to the target.

In evaluating the realism of recoil simulation, it has been found experimentally that the average trainee or even a skilled shooter, is incapable of distinguishing a recoil that is non-parallel to the barrel if the angle of application of the recoil force with respect to the barrel axis is maintained below the following tolerances. For an angle that is not zero but is in a direction to increase the apparent lift of the end of the barrel, the angle is generally undetectable even if three degrees or slightly more. For an angle that decreases the apparent lift of the barrel end or, if it causes the barrel end to move to the side, it has been emperically determined that the angle should be kept below two degrees if it is to remain unnoticeable in the simulation.

Figure 2:
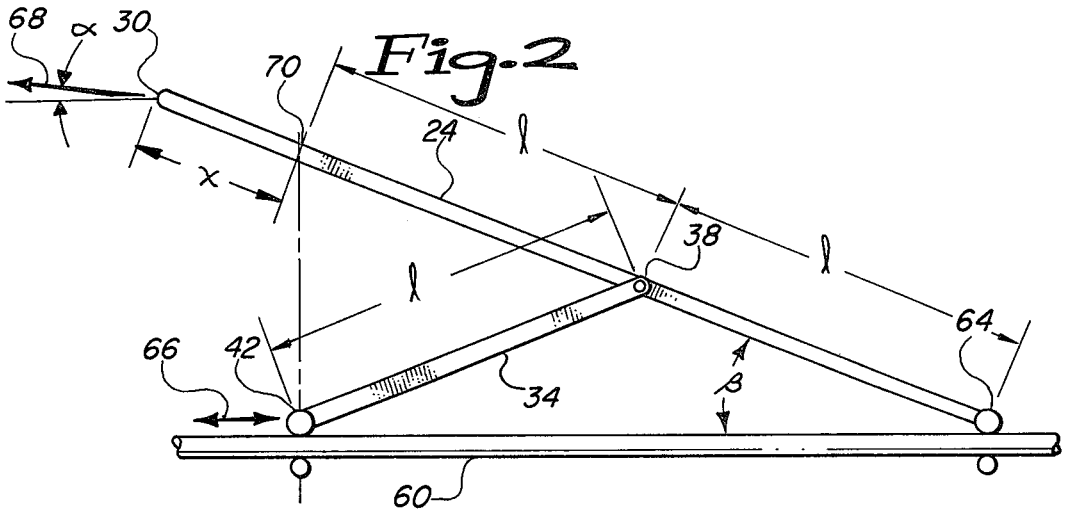
FIG. 2 is a schematic view illustrating the geometry and proportions of a mechanical linkage coupling the weapon to the recoil drive mechanism.

It is a feature of the invention that the recoil mechanism of FIG. 1 will apply simulated recoil forces to the muzzle 30 of weapon 20 parallel to the nominal line-of-sight 62 to target 26, if carriage bar 60 is disposed parallel to that line-of-sight and the proportions of the recoil arm mechanism are established as follows with reference being taken to FIG. 2 of the drawing. FIG. 2 is a two dimensional representation of the geometric relationships present in the recoil arm mechanism.

As shown in FIG. 1, pivots 42 and 64 are restrained to motions in either direction of double headed arrow 66 by their respective rod and arm carriages 40 and 36. The distance between pivots 42 to 38 and 38 to 64 and between pivot 38 to point 70 are all made equal to "l" and the distance between point 21 and muzzle 30 equals $x$. Then $\alpha$ equals the angle between force vector 68 and a line parallel to carriage bar 60. $\beta$ is the angle between recoil arm 24 and carriage bar 60. With these proportions, the general expression for the angle $\alpha$ is:

$$\alpha = \arctan\left[\frac{(\tan\beta)\, x/l}{2 + x/l}\right]$$

When the distance X equals 0, then the angle $\alpha$ equals 0 for all angles of $\beta$. Also, the recoil force applied to muzzle 30 equals the force applied to rod carriage 40 by tension tape 44 if the friction and inertia of carriages 40 and 36 are negligible. Thus, if the distance X is zero, the direction of force vector 68 is parallel to carriage bar 60 independent of angle $\beta$. Since $\beta$ is varied by changes in the trainee's position, preservation of this relationship is an important invention feature necessary to maintain the realism of the simulation.

In the foregoing discussion it was assumed that the effective distance between the training weapon and the target was relatively long. When that distance is made short, for example, a few feet, then the sight line 62 does not remain substantially parallel to some nominal direction as the weapon is moved up and down or sideways one or two feet. This can be seen with reference to FIG. 3 and an illustrative example. In that figure, if the horizontal distance Y from weapon muzzle 30 to target 26 is 9 feet and the height H of the muzzle above the axis 72 of carriage bar 60 is one foot, sight line angle $\theta$ between carriage bar axis 72 and sight line 62 is 6.3°, with axis 72 being boresighted to target 26. When angle $\theta$ is this large the difference between angle $\theta$ and and angle $\alpha$ is much larger than the 2 degree point where misalignment of the force vector 68 becomes noticeable to the trainee. It is a feature of the invention that by properly selecting the length X, angle $\alpha$ can be maintained within 2° of angle $\theta$ even for close targets.

As an example with L = 1 foot, X = ½ foot and Y = 9 feet the following results are obtained:

| $\beta$ (degrees) | H (feet) | $\alpha$ (degrees) | $\theta$ (degrees) | $\alpha - \theta$ (degrees) |
|---|---|---|---|---|
| 0 | 0 | 0 | 0 | 0 |
| 15 | .65 | 3.09 | 4.13 | 1.04 |
| 30 | 1.25 | 6.59 | 7.91 | 1.32 |
| 45 | 1.76 | 11.31 | 11.06 | −.25 |

This shows a maximum angle between $\alpha$ and $\theta$ of 1.3° at $\beta$ = 30°.

Leaving each of the length parameters the same but moving target, 26 up 0.1 foot causes the following results:

| $\beta$ (degrees) | H (feet) | H − .1 (feet) | $\alpha$ (degrees) | $\theta$ (degrees) | $\alpha - \theta$ (degrees) |
|---|---|---|---|---|---|
| 0 | 0 | −.1 | 0 | −.64 | .64 |
| 15 | .65 | .55 | 3.09 | 3.50 | −.41 |
| 30 | 1.25 | 1.15 | 6.59 | 7.28 | −.69 |

-continued

| $\beta$ (degrees) | H (feet) | H − .1 (feet) | $\alpha$ (degrees) | $\theta$ (degrees) | $\alpha - \theta$ (degrees) |
|---|---|---|---|---|---|
| 45 | 1.76 | 1.66 | 11.31 | 10.45 | .86 |

This shows a maximum angle between $\alpha$ and $\theta$ of 0.86° at $\beta = 45°$. This arrangement can thus be used to provide realistic simulation of weapon recoil direction even when using a close target as the aiming point.

The recoil forces applied to the weapon muzzle are generated by a continuously rotating motor 48. As described above, this force is transmitted to rod carriage 40 by tension tape 44 via recoil clutch 50 and recoil tape drum 46. Clutch 50 can be magnetic, magnetic particle, air or oil actuated. For the simulation of small arms recoil, a magnetic clutch is very adequate. The pull on tension tape 44 during the simulated recoil is then determined by the diameter of recoil tape drum 46 and the slip torque of clutch 50 when energized. With a magnetic clutch, its slip torque and thus recoil forces, can be controlled by the magnitude of the energizing current through clutch 50. The duration of the recoil force can be controlled by controlling the duration of the current through the clutch 50. In most cases the most realistic recoil simulation is achieved by use of a maximum force for a minimum time.

When the training weapon is a typical rifle, it has been found that good recoil simulation can be provided with 50 pounds of force applied by tension tape 44 for 0.015 second. If the rifle is a U.S. Military Type M-16, its weight and that of the portion of the recoil simulating mechanism that is accelerated, is approximately 6 pounds. These parameters result in a final rifle velocity (ignoring any restraint provided by the shoulder or arms of the trainee) of $50/6 \times 386 \times 0.15 = 40$ inches per second. If recoil tape drum 46 is made to have a 4 inch circumference, a motor speed of $(40/4) \times 60 =$ 600 RPM, is required. This, obviously can easily be provided.

From the foregoing, it can be seen that the recoil drive mechanism of FIG. 1 can realistically simulate the necessary forces. Also, when magnetic clutch 50 is not energized the training weapon is free to move over wide limits back and forth and sideways with respect to the target with an effort that is substantially the same as the weapon alone, plus that of any friction in the rod and arm carriages and pivots of recoil arm 24. Further, irrespective of the position of rod carriage 40 on carriage bar 60, the same force will be applied by tension tape 44 whenever clutch 50 is energized.

Figure 4:
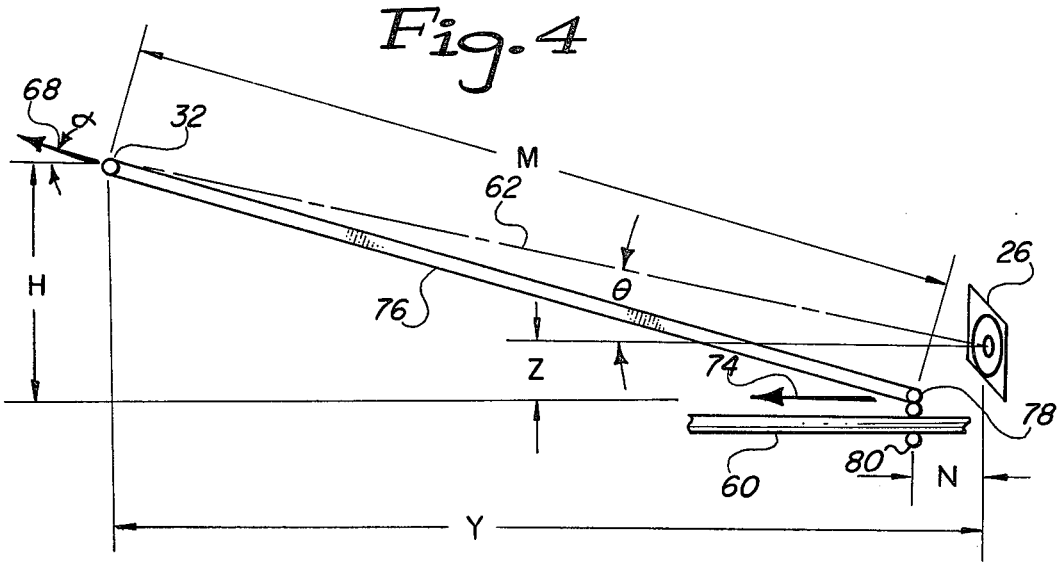
FIG. 4 is a schematic view illustrating the geometry and proportions of another embodiment of mechanical linkage for coupling the weapon and recoil drive mechanism.

Another embodiment of the mechanical linkage of the invention used to couple the recoil generator and weapon, is shown in schematic form in FIG. 4.

It is a feature of the invention that with the embodiment of FIG. 4, only compression forces are applied to the ends of recoil arm 76 and no bending forces.

Figure 3:
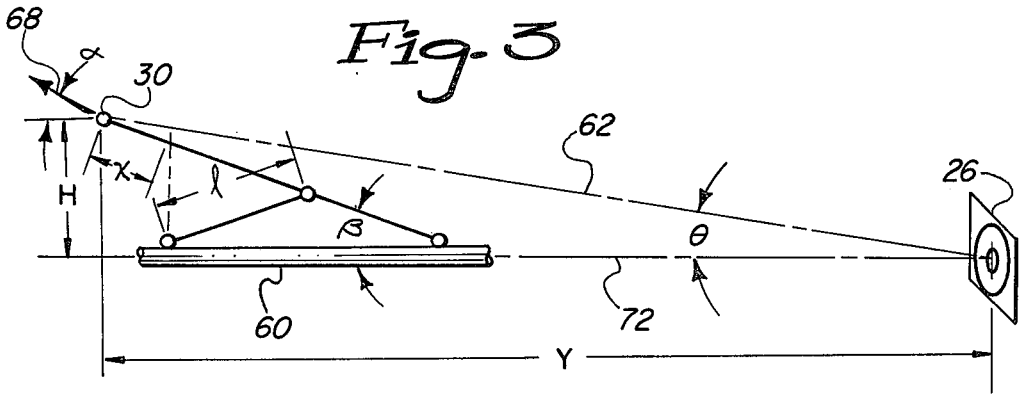
FIG. 3 is a schematic diagram illustrating the effect of variations in weapon aiming geometry.

The FIG. 4 embodiment is mechanically considerably less complex than the embodiment of FIGS. 1–3. As will appear from the following example, this simplicity does not detract from the recoil simulation. If in FIG. 4, Y and M both equal 9 feet and Z = 0.3 feet, then determining the angle $\alpha$ of the recoil force vector 68 and the angle $\theta$ of the sight line 62 from the expressions $\alpha =$ arcsin $^{H}/M$ and $\theta =$ arctan (H-Z,/Y), we find:

| H (feet) | $\alpha$(Degrees) | $\theta$ (Degrees) | $\alpha - \theta$(Degrees) |
|---|---|---|---|
| 0 | 0 | −1.9 | 1.9 |
| .5 | 3.18 | 1.27 | 1.91 |
| 1.0 | 6.38 | 4.45 | 1.93 |
| 1.5 | 9.59 | 7.59 | 2.0 |

As can be seen from this chart, the error $\alpha - \theta$ remains almost constant at 2°. This error can almost entirely be corrected for by raising the sight line of the training weapon approximately 2°.

Moving the weapon closer to the target 26 as for example making Y = 8 feet, M = 7 feet and maintaining Z at 0.3 feet, we find:

| H (feet) | $\alpha$(degrees) | $\theta$ (degrees) | $\alpha - \theta$(degrees) |
|---|---|---|---|
| 0 | 0 | −2.15 | 2.15 |
| .5 | 4.1 | 1.43 | 2.67 |
| 1.0 | 8.2 | 5.00 | 3.2 |
| 1.5 | 12.4 | 8.53 | 3.87 |

Here, even with this extreme closeness of range, the error $\alpha - \theta$ is such that raising the sight line of the training weapon by 3° leaves a resulting error in force direction that varies from −0.85° to +0.87°. These angles are well within the range found to provide good simulation and hence, the FIG. 4 embodiment provides excellent simulation of the recoil force direction.

While the foregoing described embodiment of FIG. 4 is simple, lightweight and durable, one bad effect that can be encountered with it is a low frequency transverse vibration of recoil arm 76 after force is applied, as by vector 74, to produce the simulated recoil. If this vibration does occur it is both very obvious and very disturbing to the person using the training weapon. This problem can be prevented by adding damping to recoil arm 76.

Figures 5, 6, 7:
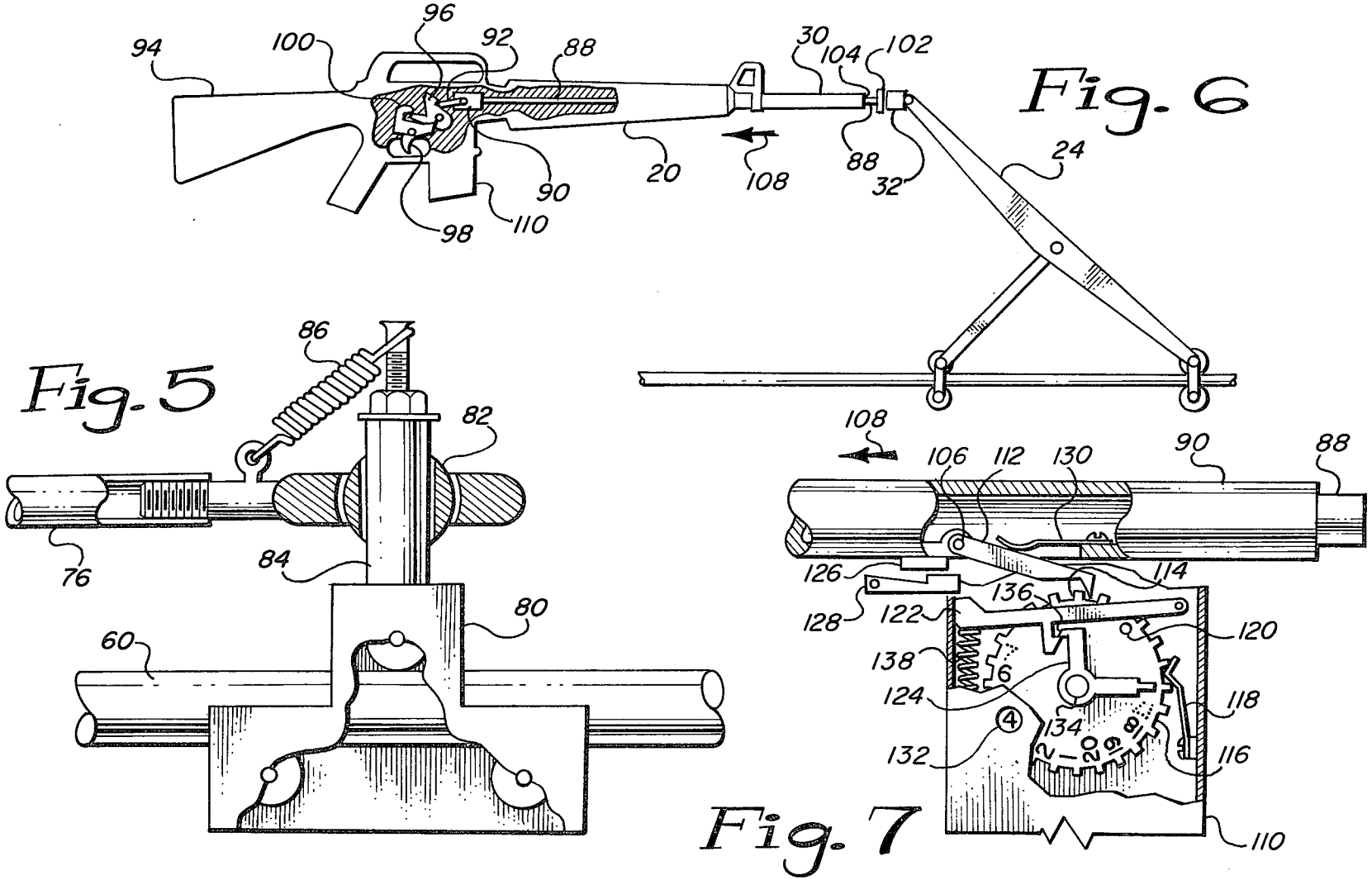
FIG. 5 is a detailed view of the pivot arrangement used in the FIG. 4 embodiment.
FIG. 6 is a schematic view illustrating the use of the recoil simulating device of the invention to effect weapon hammer and trigger recocking.
FIG. 7 is a schematic view illustrating the use of the recoil simulating device of the invention to effect round counting and empty magazine simulation.

One convenient place to add the required damping to arm 76 is at pivot 78, as shown in FIG. 5 in which vertical vibration damping is added. Spherical rod end bearing 82 is secured to the end of recoil arm 76 and provides the required pivot action. Force is applied to bearing 82 through pin 84. Bearing 82 is free to move up and down on pin 84. Spring 86 supports the weight of bearing 82 and recoil arm 76. It also provides a horizontal force component to hold the inside of bearing 82 against pin 84. This creates controlled sliding friction which damps vertical oscillations of arm 76. Any horizontal component of oscillation of arm 76 can be damped by providing an equivalent sliding friction restraint of pin 84. Obviously, viscous damping can also be used to provide any required damping. However, it has been found that for reasonable lengths of arm 76, on the order of those given in the examples above, simple sliding friction provides the necessary damping of transverse vibration.

The recoil arm embodiment of FIG. 4 is also amendable to the application of recoil energy in a manner similar to the embodiment of FIG. 1. In this embodiment the tension tape is connected directly to arm carriage 80 to provide the force indicated by vector 74. In all other respects the recoil drive mechanism of FIG. 1 would be identical in form and operation.

The description of the foregoing embodiments of the recoil simulator of the invention has concerned itself only with a realistic recoil simulation. However, whenever the training weapon must simulate semi-automatic or automatic fire, it becomes necessary to move the weapon bolt to recock the trigger. It is a feature of the invention that the simulated recoil force may also be used to effect simulated recocking action, round counting, empty magazine simulation, simulated cartridge extraction, ejection and chambering ammunition belt advance, etc., where such simulations are desired.

In most semi or fully automatic small arms, bolt travel to effect recocking and necessary cartridge movement is on the order of one inch or more in a reciprocating motion, first toward the trainee and then away. While this is the usual requirement, realism of the simulation is not impaired if this motion is reduced to ½ inch or less and the weapon modified to function with this shortened bolt travel. With bolt travel included as a part of the recoil simulation, the force applied at universal joint 32 is not immediately applied to the body of training weapon 20 but is first applied to move the bolt, hammer and trigger mechanism to effect recocking, round counting, or cartridge movement.

As described above, good recoil simulation is achieved when a 50 pound force is applied to the recoil arm by tension tape 44. When there is ½ inch of pretravel to effect recocking, etc., prior to applying force to the body of the training weapon and assuming a 2 pound weight for the accelerated recoil generator structure, there is a velocity after travel of ½ inch of:

$$v = \left(2 \times \frac{50}{2} \times 386 \times \frac{1}{2}\right)\frac{1}{2} = 98 \text{ inches per second}$$

If recoil tape drum 46 is 4 inches in diameter, the required motor speed and time are then:

$$\text{RPM} = \frac{98}{4} \times 60 = 1460 \text{ RPM}$$

$$\tau = \frac{98}{\frac{50}{2} \times 386} = 0.010 \text{ seconds}$$

Since these values are also all readily obtainable and within the range of those that provide good recoil simulation, the recoil simulator can be used to effect recocking, etc., without loss of realism. FIG. 6 shows the application of the simulator of FIG. 1 to effect recocking in a training weapon where only bolt action to recock the trigger is required in addition to recoil simulation.

In FIG. 6, recoil arm 24, when actuated, moves universal joint 32, barrel rod 88, bolt 90 and linkage 92 toward weapon stock 94. With weapon stock 94 restrained, as for example against the trainee's shoulder, this entire assembly of parts will move relative to weapon 20 in the direction of vector 108. The first restraint of the backward motion of this assembly of parts occurs when linkage 92 contacts hammer 96.

As linkage 92 continues to move backward relative to weapon 20, it forces hammer 96 back relative to the weapon and recocks it by engaging either trigger 98 or disconnector 100. After the end of this travel, as universal joint 32 continues to move toward weapon 20, it carries with it resilient washer 102 which contacts the end of barrel 104 at which time the full force from recoil arm 24 is applied to weapon 20 to effect the transmission of the typical "kick" forces to the weapon and, of course, the trainee. The action of the mechanism when the weapon is to simulate automatic operation, is substantially identical, but allows selective disabling at the disconnector to prevent trigger latching.

FIG. 7 shows the further application of the simulator of FIG. 1 to effect round counting and empty magazine simulation. Bolt 90 and lever 112 are shown in the forward position relative to weapon mounted magazine 110. Lever 112 is pivotally secured to belt 90 by pivot 106. The initial motion of barrel rod 88, bolt 90 and lever 112, due to simulated recoil force, is in the direction of vector 108. Since magazine 110 is held by the body of the weapon, the initial motion of bolt 90 is in the direction of vector 108 relative to magazine 110. The initial motion of bolt 90 carries lever 112 over center tooth 114 on gear 116. Formed detent spring 118 maintains the detented position of gear 116 as lever 112 pulls back over center tooth 114. Spring 130 maintains lever 112 in contact with gear 116. As previously described with respect to FIG. 6, after bolt 90 has traveled approximately ½ inch relative to the magazine and the body of the weapon, the bolt motion is stopped relative to the weapon by the action of resilient washer 102 on the end of barrel 104. The bolt assembly then reverses direction relative to the magazine as recoil arm 24 reverses its direction with cessation of the application of recoil force to it.

As lever 112 moves forward with the bolt 90, it rotates gear 116 one tooth relative to detent spring 118. When there are two simulated rounds left in the magazine 110, release pin 120 is ready to engage bolt lever catch 124. Then, the action of the bolt assembly and lever 112 rotates gear 116 causing release pin 120 to contact and rotate bolt lever catch 124 about its pivot 134 and, in turn, releasing bolt lever 122 from catch 136. This allows bolt lever spring 138 to lift bolt lever 122 to force bolt catch 128 in contact with the bottom surface of bolt stop 126. The next action of the bolt, with 1 simulated round remaining in the magazine, allows bolt catch 128 to rise in front of bolt stop 126 when the bolt is at the back of its travel. The bolt is thus prevented from moving forward when there are no rounds remaining in the magazine. In this position the bolt 90 prevents the trigger from being actuated which is the normal arrangement in an actual weapon.

The magazine 110 is loaded by manually rotating gear 116 until the number on gear 116 indicating the desired number of rounds appears at indicator window 132. Magazine 110 is charged by pushing down bolt lever 122 and by engaging bolt lever catch 124.

Just one arrangement of round counting and bolt stopping has been described. However, the technique can be readily adapted to other weapon arrangements and can be used to store chamber condition in the bolt assembly and be interlocked with a trigger switch so that removing and inserting the magazine does not change simulated weapon arming conditions until the bolt is actuated manually as in a normal weapon.

If, in effecting a particular simulation, it is necessary to provide either more motion for cocking or another simulation or, if less travel of the recoil mechanism is desired before it contacts the weapon barrel then, obviously, a simple additional linkage or hydraulic/pneumatic multiplier can be inserted between barrel rod 88 and linkage 92 to multiply the travel distance of linkage 92 compared to that of barrel rod 88.

In the above described embodiments, recoil forces were generated by a motor-clutch assembly and applied to the recoil arm by a tension tape. However, low friction pneumatic or hydraulic cylinder actuators can provide the same type of recoil forces in combination with free movement. While such actuators are not preferred for small arms recoil simulation because of the added complexity of their power source, nevertheless, for simulating the recoil forces of a large weapon, such actuators are desirable for generating the large forces required.

From the foregoing description, it can be seen that the invention is well adapted to attain each of the objects set forth together with other advantages which are inherent to the apparatus. Further, it should be understood that certain features and subcombinations are useful and may be employed without reference to other features and subcombinations. In particular, it should be understood that in the several embodiments of the invention there has been described a force generator in which an impulse of force is accurately directed away from either a close or distant target and is applied to an object at any point in space within the mechanical freedom limits of the apparatus and that this force impulse can be further advantageously utilized to actuate mechanisms within the object to which the force is applied.

The detailed description of the invention herein has been with respect to preferred embodiments thereof. However, it will be understood that variations and modifications can be effected within the spirit and scope of the invention as described hereinabove and as defined in the appended claims.

What is claimed is:

1. Recoil simulating apparatus for a weapon firing at a target scene comprising weapon means including barrel means, base support means, recoil mechanism means comprising universal joint means connected to linkage means and connecting said base support means to said weapon means through said universal joint means, said universal joint means being mounted coaxial, to said barrel means, and recoil force generating means connected to said linkage means and adapted to apply force thereto for each simulated firing of said weapon means whereby simulated recoil forces are applied to said weapon means substantially coaxial to the barrel of said weapon means.

2. A recoil simulating apparatus in accord with claim 1 wherein said recoil force generating means is adapted to apply said simulated recoil forces substantially parallel to the barrel of said weapon means.

3. A recoil simulating apparatus in accord with claim 1 wherein said recoil force generating means comprises continuously operating motor means having an output shaft and recoil tape drum means, recoil tape means connected to said recoil tape drum means and extending therefrom and connected to said recoil mechanism means, and selectively actuatable clutch means connecting said output shaft and said recoil drum means whereby actuation of said clutch means couples said output shaft to said recoil tape drum means for the duration of said clutch actuation.

4. A recoil simulating apparatus in accord with claim 3, further comprising slack tape drum means secured to said recoil tape drum means, and slack tape means connected to said slack tape drum means and extending therefrom and connected to said recoil mechanism means.

5. A recoil simulating apparatus in accord with claim 1 wherein said recoil mechanism means comprises carriage bar means secured to said base support means and generally parallel to a nominal weapon sight line to said target scene, recoil arm support means disposed on said support means and adapted to travel toward and away from said target scene and connected to said recoil force generating means, and recoil arm means pivotally connected at its one end to said weapon means and at its other end to said recoil arm support means.

6. A recoil simulating apparatus in accord with claim 1 wherein said recoil mechanism means comprises recoil arm means pivotally connected at its one end to said weapon means and at its other end to said base means, said recoil arm means being connected to said recoil force generating means.

7. A recoil simulating apparatus in accord with claim 1 wherein said recoil mechanism means comprises carriage bar means secured to said support means and generally parallel to a nominal weapon sight line to said target scene, movable arm carriage means disposed on said carriage bar means and adapted to travel toward and away from said target scene and to rotate about said carriage bar means, recoil arm means pivotally connected at its one end to said weapon means and at its other end to said movable arm carriage means, rod carriage means disposed on said carriage bar means and adapted to travel toward and away from said target scene and to rotate about said carriage bar means and connected to said recoil force generating means, and pull rod means pivotally connected both at its one end to said recoil arm means intermediate its ends and at its other end to said rod carriage means.

8. A recoil simulating apparatus in accord with claim 7 wherein said pull rod means is one-half the length of said recoil arm means, and said pull rod means is pivotally connected to said recoil arm means at the center thereof.

9. A recoil simulating apparatus in accord with claim 1 wherein said recoil mechanism means comprises recoil arm support means disposed on said support means and adapted to travel toward and away from said target scene, and recoil arm means pivotally connected at its one end to said weapon means and at its other end to said recoil arm support means.

10. A recoil simulating apparatus in accord with claim 9 wherein said recoil mechanism means further comprises transverse vibration damping means for said recoil arm means.

11. A recoil simulating apparatus in accord with claim 10 wherein said transverse damping means comprises pin means secured to said movable arm carriage means, spherical rod end bearing means secured to said recoil arm means and disposed about said pin means, and resilient means coupling said pin means and said recoil arm means thereby oscillations of said recoil arm means are damped.

12. Recoil simulating apparatus in accord with claim 1 wherein said weapon means further comprises means actuated by said simulated recoil forces to effect the simulation of trigger recocking, said means comprising reciprocating bolt means interior of said weapon means and connected to said recoil mechanism means whereby each application of simulated recoil forces effects bolt reciprocation and thereby trigger recocking.

13. Recoil simulating apparatus in accord with claim 1 wherein said weapon means further comprises reciprocating bolt means connected to said recoil mechanism means and adapted to be reciprocated by each application of simulated recoil forces, hammer means connected to said bolt means and pivotally oscillated by each reciprocation thereof, and trigger means engaged with said hammer means whereby each oscillation thereof effects trigger recocking.

14. Recoil simulating apparatus in accord with claim 1 wherein said weapon means further comprises reciprocating bolt means connected to said recoil mechanism means and adapted to be reciprocated by each application of simulated recoil forces, and magazine means removably secured to said weapon means and engaging said bolt means, said magazine means being adapted to provide selection of quantity of simulated rounds whereby each reciprocation of said bolt means effects a one round countdown of said magazine means and said magazine means further comprises bolt catch means for preventing reciprocation of said bolt means when there are none of said simulated rounds remaining.

15. Recoil simulating apparatus in accord with claim 1 wherein said weapon means is an automatic weapon.

16. The method for simulating the recoil of weapon firing comprising the steps of generating simulated recoil forces externally of said weapon for each simulated firing of said weapon, and applying said simulated recoil forces to said weapon coaxial to the barrel of said weapon through recoil mechanism means including universal joint means secured to said weapons barrel external of the weapon whereby the simulated recoil forces are applied parallel to the weapons nominal sight line to the target and the entire weapon is accelerated to effect said recoil simulation.

17. The method for simulating the recoil of a weapon in accord with claim 16, further comprising the step of damping transverse vibrations in said recoil mechanism means generated by the application of simulated recoil forces to said weapon.

18. The method for simulating the recoil of a weapon firing comprising the steps of generating simulated recoil forces externally of said weapon for each simulated firing of said weapon, applying said simulated recoil forces to said weapons barrel substantially coaxial to the barrel of said weapon, and reciprocating a bolt means within said weapon for each application of simulated recoil forces to said weapon.

19. The method for simulating the recoil of a weapon firing in accord with claim 18, further comprising the steps of pivotally oscillating a hammer means for each reciprocation of said bolt means, and selectively latching the weapon trigger means in response to each oscillation of said hammer means.

20. The method for simulating the recoil of a weapon firing in accord with claim 18, further comprising the step of engaging a magazine means with said reciprocating bolt means to effect reduction of one simulated round in said magazine for each reciprocation of said bolt means.

21. The method for simulating the recoil of a weapon in accord with claim 20, further comprising the step of blocking the reciprocation of said bolt means when there are no simulated rounds remaining in said magazine means.

22. In a method for simulating the recoil of weapon firing by means of an apparatus of the type including a target scene, a weapon means having barrel means and free to be aimed at said target scene, base support means, recoil mechanism means including universal joint means secured to and substantially coaxial with said weapon barrel means and connecting said weapon means to said base support means and simulated recoil force generating means connected to said recoil mechanism means, the improvement comprising the steps of generating simulated recoil forces in said recoil force generating means external to said weapon means for each simulated firing of said weapons means, and applying said generated simulated recoil forces through and recoil mechanism means and said universal joint means to said weapon barrel means whereby the generated forces used for simulating said recoil are applied substantially coaxial to the barrel of said weapon means and the entire weapon means is accelerated to effect said recoil simulation.

23. In a method for simulating the recoil of weapon firing by means of an apparatus of the type including a target scene, weapon means including barrel means and free to be aimed at said target scene, recoil force generating means external to said weapon means for generating simulated recoil forces for each simulated firing of said weapon means, base support means for supporting said recoil force generating means, track means secured to said base support means and generally parallel to a nominal weapon sight line to said target scene, and recoil arm means having its one end movable along said track means and connected to said recoil force generating means and its other end connected through universal joint means to the muzzle end of said weapon barrel means, the improvement comprising the steps of generating simulated recoil forces in said recoil force generating means for each simulated firing of said weapon means, and transmitting said generated simulated recoil forces to said weapon barrel means through said recoil arm means and said univeral joint means whereby the generated forces used for simulating said recoil are applied substantially coaxial to the barrel of said weapon means and the entire weapon means is thereby accelerated to effect said recoil simulation.

24. The method for simulating the recoil of weapon firing in accord with claim 23, further comprising the step of connecting the end of said recoil arm means that is movable along said track means to said recoil force generating means.

25. The method for simulating the recoil of weapon firing in accord with claim 23, further comprising the steps of providing pull rod means having its one end movable along said track means and its other end pivotally connected to said recoil arm means, and connecting said recoil force generating means to said pull rod means at its end movable along said track.

26. The method for simulating the recoil of weapon firing in accord with claim 25, further comprising the steps of maintaining said pull rod means at one-half the length of said recoil arm means, and connecting said pull rod means to said recoil arm means at the center thereof.

* * * * *